United States Patent [19]

Armstrong et al.

[11] 4,095,303

[45] Jun. 20, 1978

[54] DRY CLEANING CARPETING

[76] Inventors: John L. Armstrong, 4482 Holly Dr., Palm Beach Gardens, Fla. 33410; Edward G. Tarkinson, 125 SE. 31st Ave., Boynton Beach, Fla. 33435

[21] Appl. No.: 763,004

[22] Filed: Jan. 27, 1977

[51] Int. Cl.[2] ..... A47L 11/162

[52] U.S. Cl. ..... 15/1.5 R; 15/49 R; 15/230

[58] Field of Search ..... 15/1.5, 4, 230, 230.12, 15/230.14, 230.15, 230.16, 230.17, 230.18, 239.19, 49 R, 50 R, 98, 385; 68/68 R, 13 R

[56] References Cited

U.S. PATENT DOCUMENTS

| | | | |
|---|---|---|---|
| 1,998,244 | 4/1935 | Lang | 15/230 |
| 3,413,674 | 12/1968 | Reid | 15/230.12 |
| 3,537,122 | 11/1970 | Proffitt, Jr. | 15/230.12 |

*Primary Examiner*—Edward L. Roberts
*Attorney, Agent, or Firm*—Whittemore, Hulbert & Belknap

[57] ABSTRACT

Removal of soil or stains from carpeting by a dry cleaning process, in which a pad including yarn selected in accordance with the carpet material and an intermediate reduced area of metal foil is rotated in contact with a carpet area moistened with a first cleaning solution including volatile hydrocarbons such as lower petroleum fractions, detergents, a surfactant, and water, over which a second solution of water and hydrogen peroxide is applied. Pad rotation establishes a controlled electrostatic field, and vapor, liquids, soil particles, etc., are drawn into the pad.

24 Claims, 5 Drawing Figures

FIG. 3
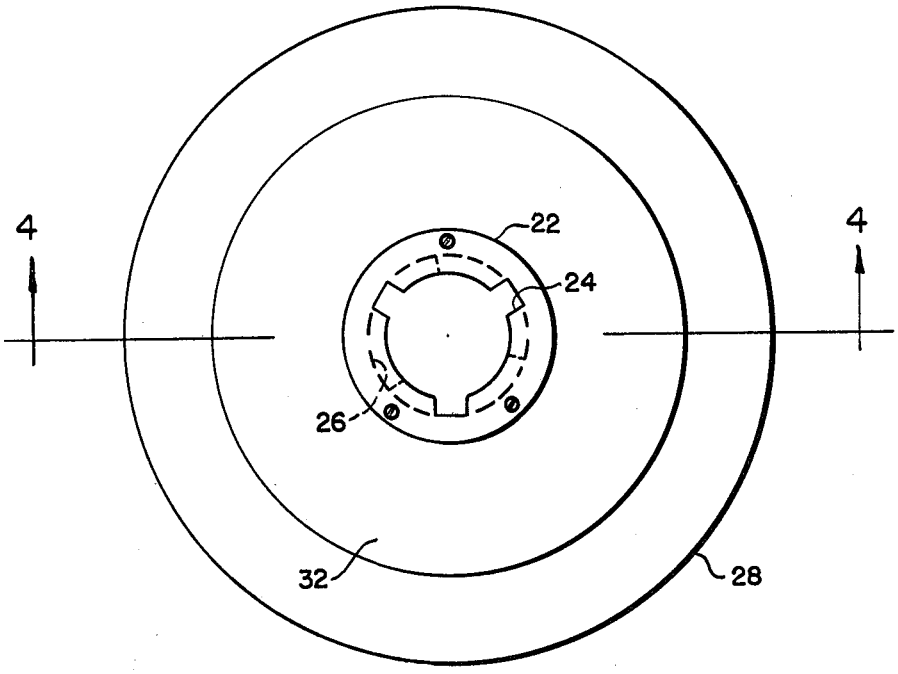
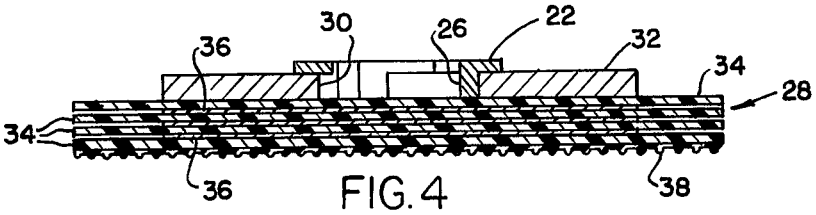
FIG. 4
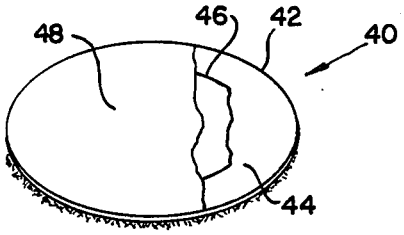
FIG. 5

DRY CLEANING CARPETING

SUMMARY

The present invention represents a radical departure from a prior copending application Ser. No. 738,707, filed by John L. Armstrong on Nov. 4, 1976. In the present invention, the operation is essentially a dry cleaning operation in which the solution applied to the carpet is substantially completely eliminated. THe cleaning action is the result of establishment of a static electric field, and also the liberation of oxygen at the cleaning site.

Described in general terms, a dry cleaning solution is provided characterized in the inclusion of a hydrocarbon, which is preferably a low petroleum fraction, which is dissolved in a carrier, together with detergents, and preferably a surfactant. This solution is sprayed lightly over a carpet area to be cleaned, and an approximately equal amount of a mixture of water and hydrogen peroxide is sprayed over the area. The amount of liquid is sufficient to moisten the carpet pile, but not to saturated the carpet.

The cleaning site is treated by rotating a pad in contact therewith, the pad being built up of layers so as to establish a static electric field as the result of friction, and to maintain this field as a flow of static electricity takes place from the pad to a polishing machine which drives the pad. Essentially the pad contains a pile or yarn fiber contacting the carpet and selected from materials suitable to generate the static field with the particular carpet material.

The operation dries the sprayed area substantially completely, eliminating the cleaning solution, and carrying soil and stain materials from the carpet into the pad. During the operation, the cleaning site may become so dry as to cause the static field to increase in strength to a point where it resists rotation of the pad, including actually stalling the machine in some cases. When this occurs, a slight spray application of additional cleaning solution permits continued rotation of the pad. If the surface of the pad becomes loaded, the machine may be moved to an adjacent dry area of carpet, and the static electric field will cause the dirt or other accumulation from the carpet to move upwardly into the pad, providing a lower portion capable of retaining additional material.

BRIEF DESCRIPTION OF THE DRAWINGS

FIG. 3 is a plan view of the drive assembly.

FIG. 4 is a sectional view on the line 4—4, FIG. 3.

FIG. 5 is a perspective view of the cleaning pad, with parts of lamina removed. FIG. 6 is a fragmentary diagrammatic showing of details of the cleaning pad.

COMPLETE DESCRIPTION

Figures 1, 2:
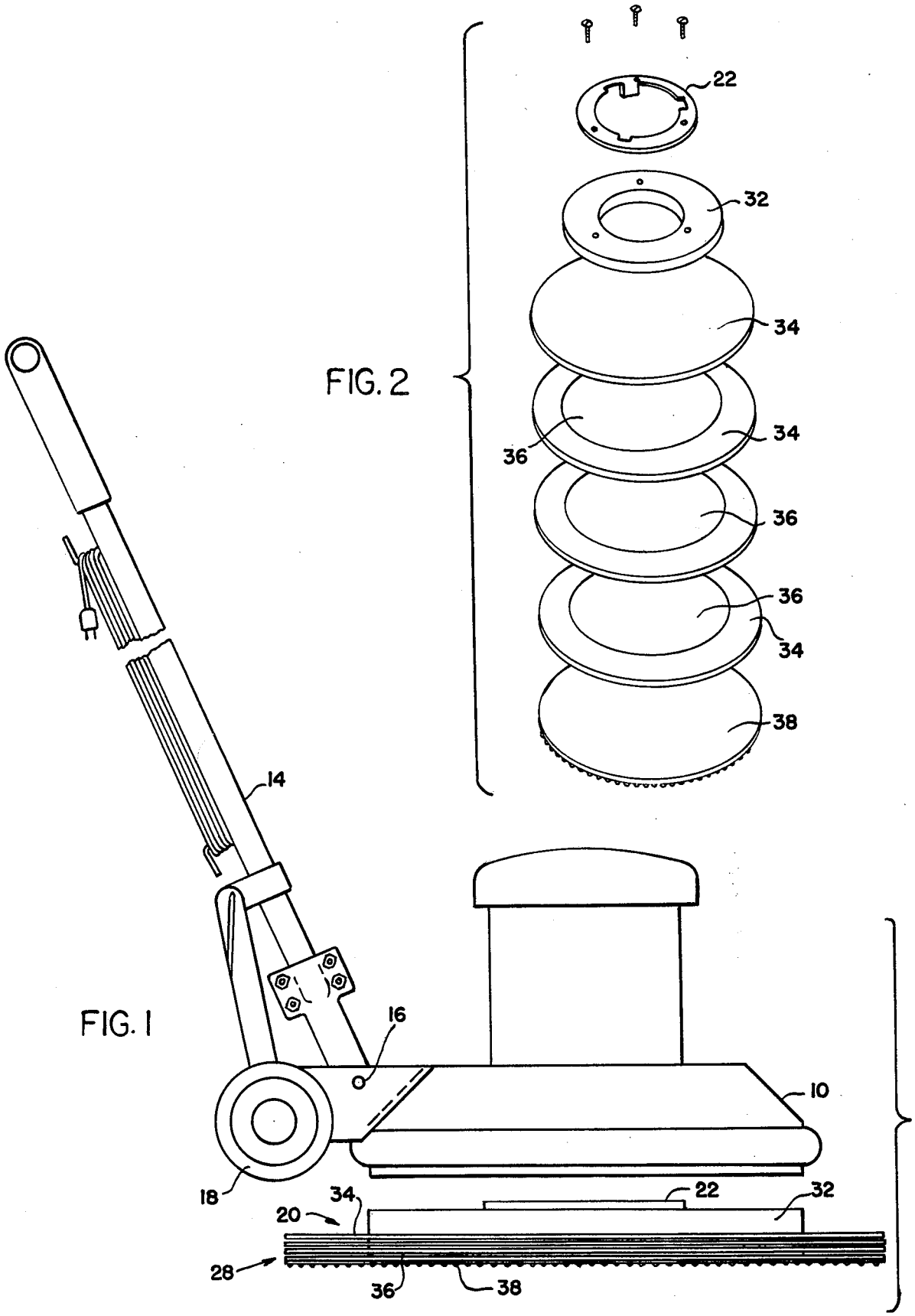
FIG. 1 is an elevational view of the carpet cleaner.
FIG. 2 is an exploded view of the drive assembly and pad, seen at the bottom of FIG. 1.

The present invention comprises the cleaning machine, including a specially designed drive assembly, as seen in FIGS. 1–4; a special cleaning pad, as illustrated in FIG. 5; and a particular cleaning solution. These aspects of the invention will be described under separate headings, below.

The Machine

As shown in FIG. 1, the machine comprises a frame or main support 10 carrying an electric drive motor 12 having a vertical drive shaft (not shown). A handle 14 is pivoted to the frame 10 as indicated at 16. The frame has support wheels 18, and in use the frame, or a cleaning pad secured to the frame, rests on the carpet as is usual in a floor polishing machine.

Power for the motor 12 is provided through an extension cord which includes a ground connection so that accumulation of an excess static charge can be prevented by continuous bleed-off as friction of the pad on the carpet tends to build up the charge.

Connected to the drive shaft of the motor 12 is a drive assembly 20 shown in detail in FIGS. 2–4. A metal drive collar 22, which may conveniently be an aluminum casting, has drive recesses 24 by means of which the collar is keyed to the motor drive shaft. The collar has downwardly extending integral legs 26 which are of a length to engage a laminated structure 28 through an opening 30 in a drive block 32.

Drive block 32 is formed of a plaster material and connected to the laminated static accumulating structure 28, wich comprises a plurality of circular disks 34 of a suitable insulating plastic material such as an acrylic resin sold under the trade name Plexiglas. Between adjacent disks 34 are laminated circular metal foil disks 36 having a somewhat smaller overall diameter than the disks 34. To the underside of the bottom disk is attached a slightly conducting drive pad 38 which may be formed of silicon rubber filled with metal powder and having a roughened drive configuration at its lower surface. The laminae are connected by a suitable bonding agent.

In a specific example of drive assembly, there was laminated together four disks of Plexiglas, 0.250 in. thick and having a diameter of $16\frac{7}{8}$ in. Intermediate each adjacent pair of these disks was an aluminum foil disk having a thickness of 0.001 in. and a diameter of $12\frac{1}{8}$ in. To the upper surface of the uppermost disk was an annular drive block, also formed of Plexiglas, and having a thickness of 1 inch and an outside diameter of $12\frac{1}{8}$ in. At the bottom there was provided a rubber drive pad, having at its bottom surface a multiplicity of $\frac{1}{8}$ by $\frac{1}{8}$ in. drive nubs. The drive pad was formed of silicon rubber, filled with up to 30% aluminum filings or powder.

These elements were bonded into a solid structure by an application of methyl ethyl ketone (MEK) which provides an essentially molecular fusion between the laminae. The resulting structure provides a plurality of series connected condensers.

The motor is operable to rotate the drive assembly and pad at about 1700–1800 R.P.M.

WASHING-CLEANING PAD

The washing-cleaning pads are illustrated in FIG. 5. These pads are employed by positioning them in initially dry condition on the moistened carpet area to be cleaned, and the drive assembly 20 of the machine is brought in position to rest on the top of the pad, where the roughened surfaces establishes driving contact therewith.

The pad 40 has as its bottom component 42 a disk of woven plastic monofilament fabric into which is hooked or needled a multiplicity of resin/wool yarn. The woven disk in a successful practice of the invention was formed of nylon monofilament thread and the yarn was provided in short sections with the free ends projecting through the fabric to form the lower surface of the bottom sub-assembly with the intermediate portion spanning three or four strands of the woven monofilament fabric disk. The lengths of the free ends of the yarn was such that the entire bottom surface of this bottom sub-assembly was formed by short lengths (about ½ in.) of the end portions of the yarn. In FIG. 5, this bottom sub-assembly is indicated in its entirety at 42 without attempting to illustrate individual monofilaments or yarn sections.

The upper surface of this bottom sub-assembly was provided with a spray coating 44 about 0.008 in. thick, of silicon rubber. In the actual practice, this rubber was #734 Dow Corning RTV silicon rubber. Over this rubber coating was applied a disk 46 of aluminum foil, having a thickness of 0.002 in. and having a diameter about 2 inches smaller than the rubber coated bottom sub-assembly 42. Finally, a top coating 48 of the same rubber wads applied over the aluminum foil and the laterally exposed rubber coating 44 of the bottom sub-assembly 42. Thus, the aluminum disk was thus completely covered at top and bottom with the rubber, and contitutes a condenser or capacitor connected in series between yarn and fabric sub-assembly 42 and the drive assembly of FIG. 4.

The components of the pad are bonded together by the sprayed rubber coatings, which cure to dry, non-tacky condition. Similary, the components of the drive assembly comprising the foil and plastic disks are permanently bonded by a suitable bonding agent. For this purpose, methyl ethyl ketone (MEK) has proved entirely satisfactory.

The material of the yarn which forms the carpet-contacting surface of the pad is selected with reference to the carpet pile material to act as a strong generator of static electricity when rubber thereover. This property is herein referred to as a high coefficient of static friction. Nylon and wool have this relationship, and a nylon yarn surfaced pad is effective on a carpet whose pile is entirely or partly formed of wool.

It will be recognized that the insulated metal foil disks constitute a multiplicity of series connected condenser-like devices.

In FIG. 6 there is a diagrammatic showing of the details of the cleaning pad sub-assembly 42. Here the loosely woven fabric 42 is shown as comprising spaced parallel elements 42*a*, 42*b*, 42*c*, 42*d*, 42*e* and 42*f*, crossed by parallel elements 42*g*. The yarn comprises elongated bundles, only two of which are illustrated in the figure. The first bundle has an intermediate portion 42*j* extending above lements 42*a*, 42*b*, 42*c* and 42*d*, with depending ends 42*h* and 42*i*. The second bundle illustrated has an intermediate portion 42*k* extending across elements 42*c*, 42*d*, 42*e* and 42*f*, and has depending ends 42*m* and 42*n*. It will be understood that harn bundles extend through all openings between fabric elements.

SOLUTIONS

While different specific ingredients may be used to make up the cleaning solution, the essential required component is a volatile hydrocarbon such as a lower petroleum fraction, capable of dissolving materials constituting stains or soiled areas on the carpet. This hydrocarbon is in part vaporized by heat generated during the operation, and in part caused to migrate into the cleaning pad by the flow of static electricity as it is continuously generated.

Since the operation results in the generation of static electricity, it is desirable to provide for noninflammability, both of the solution, and any vapors resulting from its use. Accordingly, the solution contains a large percentage of water.

The cleaning action is improved by the addition of alcohol as a solvent, which also maintains the components of the cleaning solution in suspension or solution, and by the addition of suitable detergents. Also, the addition of a surfactant is desirable, as will be subsequently described in detail.

A specific example of a solution which has proved highly satisfactory in use is:

| Material | % by Volume |
|---|---|
| Volatile hydrocarbon such as naphtha or other lower petroleum fraction, | 7.0 |
| Butyl alcohol, | 2.0 |
| Sodium sulphate, | 0.7 |
| Sodium tripolyphosphate, | 10.0 |
| Surfactant, | 0.3 |
| Water, | 80.0 |

Excellent results are obtained using a surfactant sold under the trademark "Alphonic" 1618-65 non-ionic by Conoco Chemicals Div., Continental Oil Co. This material is described by the marker as $Ch_3\ (CH_2)_x\ CH_2\ (OCH_2CH_2)_n\ OH$ where the approximate values of $x$ and $n$ are 14.5 and 10.5 respectively.

This material is sold with a warning that it should not be used in conjunction with strong oxidizing agents such as concentrated hydrogen peroxide. However, in accordance with the present invention, the cleaning solution described above is applied as a spray to a carpet, and a second spray application of aqueous solution of hydrogen peroxide is made. This second solution in a successful practice of the invention was 12% hydrogen peroxide sold with a strength designation of "135 volume", and 88% water, by volume. Thus, the surfactant Alphonic and the oxidizing agent hydrogen peroxide are used in conjunction, but are not mixed prior to, application to the carpet.

The fact that both solutions contain large percentages of water permits their safe use, even in an environment in which electrical sparks may be present.

OPERATION

The electrostatic dry cleaning disclosed herein has been designed specifically for carpet cleaning. It has been thoroughly tested with great success on white and yellow carpeting for which no completely satisfactory cleaning process was previously available.

The basic cleaning solution of volatile hydrocarbon solvents such as lower petroleum fractions, e.g., naphtha, with water-soluble, non-foaming detergents, e.g., suitable sodium salts, alcohol as a preferred addition, water, and a surfactant, is applied to the area of the carpet to be cleaned. The solution is sprayed lightly over the area, in sufficient amount of moisten the pile but not to soak or thoroughly wet the carpet through. Over this is applied a further light spray, in approximately equal amount, of a mixture of about 88% water and 12% part hydrogen peroxide, 135 volume. The addition of this last is particularly effective in the liberation of oxygen which aids in oxidation during the cleaning cycle, and in addition is also particularly effective in eliminating residual odors.

The establishment of an effective electrostatic field and flow-through resulting therefrom is closely related to the amount of solution supplied to the cleaning site. A minimum amount of solution is applied so that the static field is maintained at its highest usable range. If too much static is generated, the rotation of the cleaning pad and its driver may be opposed by static pull between the pad and the carpet, in some extreme cases freezing the pad against rotation. In such case, more solution is sprayed onto the cleaning site until the magnitude of the static charge is reduced to a workable point.

Areas adjacent the cleaning site are left dry, and the machine may be moved to these areas to eliminate excess moisture from the pad, and to raise accumulated soil particles into the pads.

When a pad becomes inefficient because it is loaded with soil particles and the like, it may of course be replaced with a clean, dry pad. The soiled pad may be washed for removal of contaminants, the reused.

It will be recognized that the insulated metal foil disks constitute a multiplicity of series-connected condenser-like devices, which cause a continuous, substantially smooth-out or uniform bleed-off of the continuously renewed static charge on the pad, and which cause the solvent vapors, soil, and detergent to migrate upward from the carpet to the cleaning pad.

It will be noted that the condensers including the metal foil disks are of relatively large area, being approximately one foot in diameter. Electrostatic dry cleaning is a way of removing stains and dirt from carpeting, which may be carried out with only the small amounts of water included in the sprays, leaving the finished carpet clean, dry and odor-free. The operation provides a great saving in time and labor, and is not injurious to the carpet pile. It is quiet, safe, and presents no inconvenience to the household.

Like ordinary dry cleaning, a carpet can be "spotted" before the general cleaning process, and the cleaning solution can be readily modified, as will be obvious to solve specific problems such as pet or urine odors and stains, rust, blood, coffee stains, and the like.

The specially designed washer-extractor pad doubles as the static generator and condenser or capacitor which draws up the free, loosened dirt, and other residues.

The pad washes the surface being cleaned by the two solvents, loosens the dirt, mixes the different solvents together, causes rapid oxidation and heat through friction, "burns off" excess cleaning solution and dries the carpet. In addition, it generates the static electricity which in turn pulls up the soil particles and excess solution into the pad.

The backing of the pad, as before stated, is a spray coating of 0.008 in. of silicon rubber, which serves as a dielectric for the condenser or capacitor, permitting limited leakage flow or bleed-off of the charge, forming a very low voltage condenser.

As before mentioned, the pad generates static electricity and heat by friction, which coupled with the heat created by rapid oxidation caused by the hydrogen peroxide and resultant free oxygen, and solvent odors and moisture are dissipated, and soil and foreign particle are drawn into the pad.

When the process is executed properly, the pad is either dry or damp dry, after using.

If the pad generates too much static electricity and clings to the surface being cleaned, it may stall the motor. In this case, more cleaning solution must be applied to reduce the static charge. It is important, however, to carry out the operation by controlling conditions to go from a condition of too much static pull to a workable amount, rather than from a too mosit, low static environment to proper conditions.

The drive block functions as a booster in control of static charge and is specifically very effective where cleaning speed and quality are concerned.

What is claimed is:

1. Apparatus for dry cleaning a carpet which comprises a machine having a grounded frame, motor means on said frame comprising a vertical output shaft, pad driving means connected to the lower end of said shaft, a cleaning pad connected to said driving means at its underside and movable in rubbing relation over the carpet to be cleaned and of a material selected to generate a static electrical charge as a result of frictional contact with the carpet material, accumulator means comprising a plurality of condensers electrically connected to said driving means and pad, and static charge bleed-off means connected between said accumulator means and said frame.

2. Apparatus as defined in claim 1, in which said pad material comprises an open woven fabric disk, and a multiplicity of yarn segments formed of the same material, each yarn segment having free end portions extending through and below the woven fabric and an intermediae portion extending across a plurality of parallel threads of the fabric.

3. Apparatus as defined in claim 2, in which the thread and yarn are nylon.

4. Apparatus as defined in claim 2, in which the pad is readily detachable from said driving means for replacement when required.

5. Apparatus as defined in claim 2, in which said pad includes a disk of metal foil extending over the major portion of the woven fabric and yarn constituting the lower portion of said pad, and a dielectric covering both upper and lower surfaces of said foil.

6. Apparatus as defined in claim 1, said driving means comprising a flat pad driver and said condensers comprising a series of flat condenser elements all disposed in superimposed relation.

7. Apparatus as defined in claim 6, said pad driver having a lower surface configurated to establish a firm driving connection to a pad therebeneath.

8. Apparatus as defined in claim 6, said condenser elements comprising alternated disks of a plastic material and metal foil.

9. Appparatus as defined in claim 8, in which said plastic material is an acrylic plastic.

10. Apparatus as defined in claim 8, said disks being bonded together to form a unitary structure.

11. Apparatus as defined in claim 8, said foil disks being concentric with said plastic disks but of slightly smaller diameter.

12. Apparatus as defined in claim 1, in which said condensers have condenser areas on the order of about one foot in diameter.

13. Apparatus as defined in claim 1, in which said pad driver is formed of a slightly conductive material.

14. Apparatus as defined in claim 13, in which said sightly conductive material is a rubber containing up to 30% by weight of conducting particles.

15. Apparatus as defined in claim 14, in which said particles are metal.

16. Apparatus as defined in claim 1, in which said pad includes a disk of metallic sheet material extending over the major portion of the woven fabric and yarn constituting the lower portion of said pad, and a dielectric covering both upper and lower surface of said sheet material.

17. Apparatus as defined in claim 16, said condenser elements constituting alternate disks of plastic material and metal sheet material.

18. A replaceable cleaning pad for use with a carpet cleaner using static electricity, said pad comprising a loosely woven fabric disc of crossing threads, a multiplicity of yarn elements each having its intermediate portion spanning a plurality of parallel threads of said fabric disk and free end portions projecting through said disk to provide a bottom surface composed of said yarn ends, said yarn being of a material effective to generate static electricity when rubber over the pile surface of a particular carpet, said pad having a disk of metallic sheet material superimposed over said fabric disk and insulated at both top and bottom.

19. A pad as defined in claim 18, in which the metallic sheet material is metal foil.

20. A pad as defined in claim 19, in which the insulation comprises a thin coating of low conductive rubber intermediate said fabric disk and said foil disk, and a further coating of conductive rubber over said foil disk.

21. A pad as defined in claim 19, in which said disk is of metal foil.

22. A pad as defined in claim 18, in which the yarn of the pad has a high coefficient of static friction with respect to the pile material of the carpet.

23. A pad as defined in claim 18, in which said yarn is nylon where the carpet contains a substantial proportion of wool yarn.

24. A pad as defined in claim 18, in which said yarn is wool where the carpet is essentially a plastic yarn pile carpet.

* * * * *